United States Patent [19]

Meytsar

[11] Patent Number: 4,457,878

[45] Date of Patent: Jul. 3, 1984

[54] FILLING FOR EMERGENCY COOLING TOWERS TO BE USED IN NUCLEAR POWER PLANTS

[75] Inventor: Jacques Meytsar, Milan, Italy

[73] Assignee: Favra International s.r.l., Milan, Italy

[21] Appl. No.: 382,343

[22] Filed: May 26, 1982

[30] Foreign Application Priority Data

Jun. 4, 1981 [IT] Italy ..... 22134 A/81

[51] Int. Cl.[3] ..... B01F 3/04

[52] U.S. Cl. ..... 261/111; 261/DIG. 11; 376/298

[58] Field of Search ..... 261/111, DIG. 11; 376/298

[56] References Cited

U.S. PATENT DOCUMENTS

| | | | |
|---|---|---|---|
| 3,430,935 | 3/1969 | Garrett | 261/111 |
| 3,751,017 | 8/1973 | Lemmens | 261/111 |
| 3,795,486 | 3/1974 | Ekman | 261/111 |

FOREIGN PATENT DOCUMENTS

| | | | |
|---|---|---|---|
| 414720 | 9/1910 | France | 261/111 |
| 614770 | 12/1979 | Switzerland | 261/111 |
| 809906 | 3/1959 | United Kingdom | 261/111 |

*Primary Examiner*—Tim R. Miles

*Attorney, Agent, or Firm*—Browdy & Neimark

[57] ABSTRACT

An improved filling for emergency cooling towers of nuclear power plants, of the type made of a grid of tubular rods in plastic material, such as PVC, has an anchoring system by which it can withstand atmospheric depressions or overpressures up to 700 Kg/m$^2$, as required. The tubes of plastics, arranged in pairs of staggered, spaced parallel rows, are inserted to pass through two opposite walls of at least one elongated square section, perpendicular thereto and preferably of the same plastic material. The distance between the two rows is slightly less than the diameter of an auxiliary stiffering tube which is inserted between said two section walls and the two rows of tubes, transversely thereto. For each layer of filling, a particular system of fixing said square sections to the concrete structure of the tower is described to meet also the aseismatic requirements.

6 Claims, 2 Drawing Figures

FILLING FOR EMERGENCY COOLING TOWERS TO BE USED IN NUCLEAR POWER PLANTS

BACKGROUND OF THE INVENTION

The present invention relates to the filling of emergency cooling towers in nuclear power plants, in particular an improved filling of the type comprising a grid of tubes of plastic material, such as PVC, which is in a position to withstand depressions or overpressures up to 700 Kg/m$^2$, as required by safety rules.

It is known that the nuclear power plants are required to have an emergency cooling tower, which should be in a position to operate in any environmental condition, even in case of complete destruction of the station, to remove heat from the core where the nuclear reaction takes place, in order to avoid overheating giving rise to temperatures such as to cause the core itself to be melted and possible chain reactions, no longer under control, to result in catastrophic consequences.

In these emergency towers, as well as for the towers adapted to the usual operation the so-called "filling" which provides for the total surface of heat exchange with the water to be cooled, rain-like sprinkling from the tower top, is advantageously comprised of a plurality of planar rows of horizontal parallel tubes, being arranged alternately in a given direction on one plane and in the direction perpendicular thereto on the planes above and below.

It is also known that in the normally operating cooling towers these tubes are fastened at their ends and at given intervals along their length to elongated C-shaped sections, which are perpendicular to the tubes and formed with pluralities of through holes for fitting the tubes therein. The holes are conveniently made by piercing, being arranged in two parallel rows, one above the other, with the holes equally spaced apart and staggered in the two rows. The sections and the tubes fitted therein form, for each filling layer within the tower, a so-called "grid" or hurdle which rests at the ends of the sections on stands or pillars of reinforced concrete perpendicular thereto, which are part of the tower frame structure. Usually the fastening operation merely consists in tying the sections on these stands and, due to the absence of intermediate restraints, the whole hurdle structure is not very resistant, especially to bending stress. On each horizontal plane of the tower filling the grids or hurdles have alternate directions mutually at right angles, with the tubes being directed like the sections of the plane immediately below and vice versa.

This type of filling is not capable of resisting strong stresses, as required to emergency towers, the perfect operation of which is dictated by the safety rules, even under the most unfavourable environmental conditions. This is warranted by the aseismatic concrete structure of the tower in case of earthquake, but the filling structure must be in a position to withstand the strength of a cyclone or a tornado, which for safety reasons has been fixed at a value of overpressure or depression of 700 Kg/m$^2$. In these conditions, a filling structure as described above can not afford the necessary resistance, since the sections could bend such as to cause the tubes to slip off from the through holes and could break off with the consequent complete destruction of the filling. Therefore filling grids of this type are not suitable for emergency cooling towers.

Then it was also planned to use, instead of C-shaped sections but still adopting low-cost plastic material like PVC, square section support tubes which are much more bending-resistant due to their high moment of inertia. In this case the through holes for passing the tubes will be made in opposite walls of the quadrangular cross-section and directly facing each other, whereby it is no longer possible to make them by piercing. On the contrary other known cutting devices will have to be used and in general the hole diameters will have a lower precision than by piercing, thus resulting in possible, even sensible clearances with respect to the tubes therethrough. Therefore these latter when subject to strong stresses could slide in the holes and slip off from the square-section supports, in spite of the excellent bending-resistance of these.

SUMMARY OF THE INVENTION

The object of the present invention is to provide an improved filling for nuclear plant emergency cooling towers, which is capable of withstanding depressions or overpressures of 700 Kg/m$^2$, all the same being of the cheapest type with planar hurdles or grids, placed one above the other, of tubes made of plastics with end and intermediate fastening means of the same material.

This is obtained by using longitudinal sections of plastic material, two opposite vertical walls of which are formed with two correspondingly facing pluralities of holes being arranged in two parallel rows, one above the other and mutually evenly staggered, for the passage therethough of two rows of parallel tubes, transversely with respect to said sections, the distance between said two rows of tubes being such as to allow an additional tube to be forced therein in the direction of the length of said sections and between said two walls of each of them, so as to cause a slight strain of the tubes, there being also provided vertical fastening plates, each having a passage opening for said sections, and anchoring means for fixing the assembly to the wall structure of the tower. Preferably the said sections have a closed, quadrangular cross-section.

With this arrangement it is possible to obtain a higher stiffness of the filling assembly, due to the auxiliary additional tube, and in case of closed cross-section, also the inconveniences resulting from the clearance between the holes and the grid tubes can be avoided by means of a simple and economical solution according to the invention. This is inserting an additional tube of the same material (which could be even one of the tubes composing the tower filling) between the two rows of tubes and inside the section, so as to form an integral assembly by means of the clamping due to a slight strain of the tubes obtained through a proper dimensioning of the various parts.

BRIEF DESCRIPTION OF THE DRAWINGS

These and further objects and advantages of the present invention will be apparent to those skilled in the art by the following detailed description of an embodiment thereof, given by way of a non-limiting example, with reference to the drawings, in which.

DETAILED DESCRIPTION OF THE PREFERRED EMBODIMENTS

Figure 1:
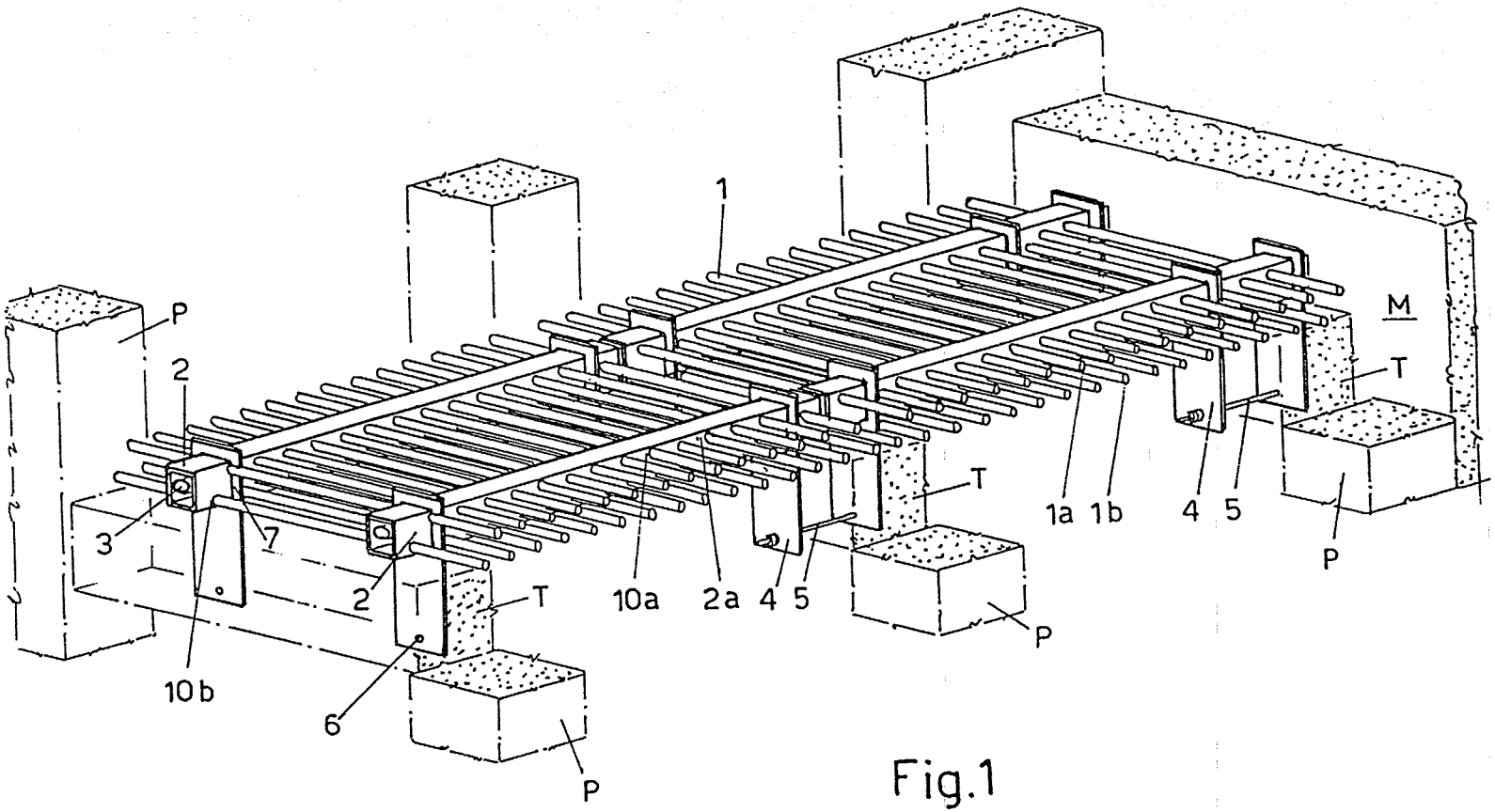
FIG. 1 is a partial, perspective view of a filling grid of tubes, according to the invention.

With reference to the drawings, in an emergency cooling tower, of which an inner wall M, beams T and pillars P for supporting the filling are shown in part, a multiplicity of planar grids or hurdles are provided, one of which is partially represented in FIG. 1. Each of these grids is formed of a number of horizontal tubes 1, all parallel and arranged in two vertically spaced apart rows, mutually staggered, of tubes 1*a*, 1*b*. Tubes 1 may be formed of whatever plastic material, preferably PVC, and are kept in position by elongated sections 2, 2', etc. of the same material, which are also horizontal and positioned perpendicular to the tubes, being equally spaced.

These sections 2 are in this case closed and of quadrangular (in particular square) cross-section. They have on the two vertical sides 2*a* two rows of mutually facing and longitudinally aligned holes, the two rows being spaced apart vertically and staggered so that each hole 10*a* of the upper row has its center substantially on the middle axis of two holes 10*b* of the lower row. Tubes 1*a* and 1*b* are caused to pass through these holes, to form the hurdle or grid of one layer of the filling. In the adjacent layer (overlying or underlying) the sections 2 are directed in the perpendicular direction, that is parallel to the tubes of the first considered layer, whereby the tubes inserted therein will have the direction of the sections 2, 2' shown in FIG. 1 and so on, alternately until the tower filling is over.

According to the invention in order to better secure tubes 1*a*, 1*b* to the support sections through elimination of the unavoidable slack between holes 10*a*, 10*b* and tubes 1*a*, 1*b* due to the drilling imprecision, and in order to increase the stiffness of the assembly, an additional tube 3 is inserted between the two rows of tubes, transversely thereto as well as in each section 2 along its longitudinal direction. Every tube 3 is also made of the same plastic material as used for the tubes 1 and elements 2, and will have its outer diameter slightly larger than the free distance between the bottom of tubes 1*a* and the top of tubes 1*b*, so that the insertion is rather forced.

Figure 2:
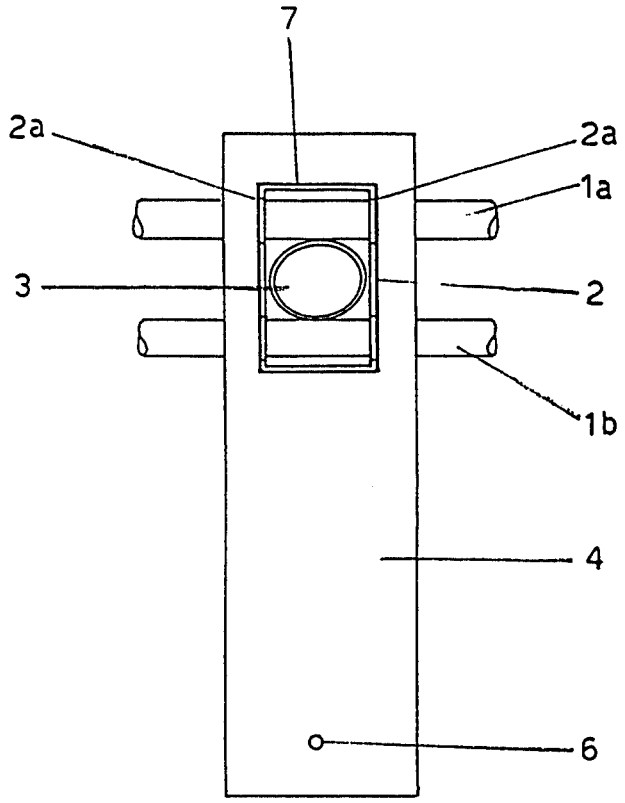
FIG. 2 shows a partial, end front view of the filling of FIG. 1, taken from one of the fastening plates.

Furthermore this diameter is less than the inner width of the section 2 to allow the above-mentioned insertion, taking into account that as a consequence of a slight buckling in the vertical direction due to the compression between the tubes 1, the tube 3 will expand in the transverse direction (see FIG. 2). Therefore, the cross-section of each element 2 may be of square or rectangular shape and in the last case with the longer side positioned vertically, but such that the shorter side is of a length not less than the free distance between the transverse tubes 1*a* and 1*b* in the vertical direction.

The elements 2, which preferably do not extend themselves integrally along the whole width of the cooling tower, but are made of aligned sections of a length from 1.5 to 2.5 m, near their ends are fixed to the supporting structures P and T of the tower by means of fastening plates 4, again of the same plastic material. These plates are caused to slip on the elements 2 through quadrangular openings 7 before mounting the tubes 1, and fixed by bolts 5 either to the beams T supported by the pillars P or directly on the inner wall M of the tower at the end sections of each element.

The sections or elements 2 are then arranged side by side, equally spaced apart at a distance of approximately one half the length of each element or section, along the whole extension of the other size of the cooling tower, directed transversely with respect to the longitudinal direction of the sections 2.

More in particular, the fastening of the assembly is carried out as follows. Each adjacent intermediate sections of element 2 are in mutual abutment in correspondence with a bearing beam T of the tower, the fastening plate 4 of the first section being positioned against one side of the beam itself, and the fastening plate of the second section is positioned against the other side. Both the plates are clamped to each other through a single bolt 5 across the beam T and an associate hole 6 in each plate. Each section adjacent to the inner wall M of the tower has preferably the outer end near the wall with a pair of plates 4 spaced apart by the same distance as between the plates of two adjacent sections. These pairs of plates are also fixed by a bolt 5 at either side of the most external beam T.

This type of anchoring not only prevents the elements 2 from excessive bending, by means of a reduction of their free span, but also provides a lower-rigidity connection between the tower structures and the system of tubes, by means of plates 4 having the hole 6 for the passage of bolt 5 at one end and the opening 7 for housing the section 2 at the opposite end. Thus, in case of earthquake, the necessary structures, which are per se aseismatic, transmit to the grid of tubes the vibrations and accelerations due to the shocks with a sensible damping.

Additions and possible variations of the above-described and illustrated embodiment of the improved filling for emergency cooling towers according to the invention can be provided without exceeding the scope of the invention itself. In particular the materials employed can be of whatever type and as auxiliary clamping tube 3 one could use one of the tubes 1 forming the filling grid. Furthermore, instead of a closed, quadrangular cross-section element, a pair of open C-shaped or double T-shaped bars, parallel and mutually facing with a tube 3 between the two vertical walls 2*a* could be used.

What I claim is:

1. An improved filling for emergency towers of nuclear power plants which comprises horizontal grid-like layers or hurdles formed of parallel plastics tubes passing through elongated support elements of the same material and perpendicular to the tubes, wherein said elements have on a pair of opposite walls two corresponding, mutually facing pluralities of equally staggered holes, arranged in two parallel, horizontal, and spaced apart rows for the passage of said tubes which are also arranged on each layer in two horizontal, parallel rows, being spaced apart of such a distance as to enable an additional auxiliary tube to be forcedly inserted under a slight strain between said two rows of tubes in the direction of said support elements and between said two opposite walls and an auxiliary tube so located, there being further provided vertical fastening plates also of the same material, each having an opening for said support elements passing therethrough and anchoring means for fixing to the frame structures of the tower.

2. An improved filling according to claim 1, wherein said support elements comprise pairs of bars having a C- or double-T-shape, parallel and mutually facing vertical walls.

3. An improved filling according to claim 1, wherein said support elements are of closed, quadrangular cross-section with vertical walls, each auxiliary tube being forcedly inserted within each element.

4. An improved filling according to claim 3, wherein said elements are formed of sections having each a length from 1.5 to 2.5 m, longitudinally aligned to cover one of the inner sizes of the tower and arranged side by side at a distance which is about one half the length of each section to cover the other size perpendicular to the first one, in the proximity of either end of each section of element there being provided one of said fastening plates, fixed to the tower structures by means of a bolt through a hole near the plate end which is opposite to the end with said opening for the passage of the support element.

5. An improved filling according to claim 4, wherein each pair of intermediate adjacent element sections join in correspondence of a beam of the tower and the end plates of the sections are abutting at either sides of the beam through which and through the holes of said plates passes one single bolt.

6. An improved filling according to claim 1, wherein said auxiliary tube has the same diameter of said tubes of the grid.

* * * * *